US007220014B2

(12) United States Patent
Lay et al.

(10) Patent No.: US 7,220,014 B2
(45) Date of Patent: May 22, 2007

(54) QUICK MOUNTING SYSTEM FOR EMERGENCY LIGHTING DEVICE

(75) Inventors: James Michael Lay, Cumming, GA (US); Richard Marvin Born, Grayson, GA (US); Paul Kenneth Pickard, Conyers, GA (US); John Evan Lane, Grayson, GA (US)

(73) Assignee: Acuity Brands, Inc., Atlanta, GA (US)

( * ) Notice: Subject to any disclaimer, the term of this patent is extended or adjusted under 35 U.S.C. 154(b) by 5 days.

(21) Appl. No.: 10/951,361

(22) Filed: Sep. 28, 2004

(65) Prior Publication Data

US 2006/0072304 A1 Apr. 6, 2006

(51) Int. Cl.
*F21L 13/00* (2006.01)
*F21V 33/00* (2006.01)

(52) U.S. Cl. ..... 362/183; 362/20; 362/155; 362/652; 362/655; 362/374; 362/404; 362/458; 307/64; 307/66; 307/326; 439/507

(58) Field of Classification Search ..... 362/20, 362/155, 183, 652, 655, 657–659, 249, 374, 362/404, 457; 315/86, 87; 307/64, 66, 326; 439/507–510

See application file for complete search history.

(56) References Cited

U.S. PATENT DOCUMENTS 4,885,474 A * 12/1989 Johnstone et al. ..... 307/66
5,810,617 A * 9/1998 Hasagawa ..... 439/510
6,142,649 A * 11/2000 Beghelli ..... 362/259

* cited by examiner

*Primary Examiner*—Jong Suk Lee
*Assistant Examiner*—Jacob Y. Choi
(74) *Attorney, Agent, or Firm*—Kilpatrick Stockton LLP

(57) ABSTRACT

An emergency lighting device adapted to be quickly and easily mounted and installed. In one embodiment, a mounting member of the device is first mounted to a desired structure and connected to an external power supply. Once mounted and completed, and emergency lighting assembly is secured to the mounting member. In certain embodiments, securing the emergency lighting assembly to the mounting member connects the device to the external power supply and energizes the device.

25 Claims, 6 Drawing Sheets

QUICK MOUNTING SYSTEM FOR EMERGENCY LIGHTING DEVICE

FIELD OF INVENTION

This invention relates to emergency lighting devices that may be quickly and easily mounted and installed.

BACKGROUND

Emergency lighting devices include circuitry that illuminate emergency lights during a power outage using a battery or similar power supply.

Because these lighting devices are relied on for emergency situations, they must be tested at the factory to ensure that they function properly. To test a typical emergency lighting device, it must be completely assembled with all of its components (including the back-up power supply) assembled and connected to one another. Next, the device's circuitry is wired to a testing unit and is tested to ensure that it will function properly during a power outage. After testing, the battery of a typical emergency lighting device must be disconnected from the device's circuitry. In typical devices, if the battery is not disconnected from the circuitry, the circuitry will remain energized and the battery's charge may drop below an acceptable level prior to installation.

Typical emergency lighting devices are difficult and time consuming to install and are not shipped in a condition ready for installation. Rather, the installer must disassemble the device, perform a number of steps, and then reassemble the device to mount and install it. Because the device is shipped with a disconnected battery, the installer must remove the device's housing and reconnect the battery to the circuitry. Additionally, the battery, circuitry and other components of the unit may obstruct portions of the housing that must be accessed for mounting and wiring the device. If so, the installer must remove those components, mount and wire a portion of the device, and then reinstall the components and replace the device's housing to complete installation.

Installation of a typical emergency lighting device may require: (1) removing the device from its packaging; (2) removing the device's cover; (3) disconnecting the wires connecting the device's lamps to its circuitry; (4) removing the device's battery; (5) knocking out mounting holes; (6) mounting the device to the desired structure; (7) reinstalling the battery; (8) reconnecting the wires connecting the device's lamps to its circuitry; and (9) reinstalling the device's cover.

SUMMARY

Unlike typical emergency lighting devices, assembly and installation of emergency lighting devices of the present invention proceeds in a relatively quick and uncomplicated manner. Installation of devices of the present invention may be done without disassembling the device or removing any components from it. Rather, emergency lighting devices of the present invention are installed simply by mounting a mounting member to a desired structure (such as a wall, ceiling, or pole), connecting a power source line to the mounting member, and then securing an emergency lighting assembly (including at least a portion of the device's circuitry, an emergency power supply, and connections for at least one light) to the mounting member. Because it is the mounting member, and not the lighting assembly, that is first mounted and connected to the external power source, the installer does not need to disassemble, remove or disconnect various components, reconnect various components or reassemble the device. Also, because the external power source may be connected without opening the housing of the lighting assembly (as discussed further below), the device can similarly be connected to the wiring or other devices necessary to test the emergency lighting devices without having to disassemble the device to access its internal components.

Additionally, the present invention may be shipped from the factory with the battery already physically (but not electrically) connected to the circuitry of the device without the battery losing its charge prior to installation. Consequently, the installer may install the emergency lighting device without opening its housing to reconnect the battery.

This invention includes a mounting member and an emergency lighting assembly. The emergency lighting assembly may include one or more lights, a battery and at least a portion of an electrical circuit. In some embodiments the portion of the electrical circuit is incomplete. By leaving a portion of the electrical circuit "open" or incomplete, the battery may remain connected to the portion of the electrical circuit in the emergency lighting assembly after leaving the factory without substantially depleting its charge. Securing the emergency lighting assembly to the mounting member completes assembly of the circuitry by connecting a jumper (associated with the mounting member) to close the circuit.

To install emergency lighting devices of this invention, the installer first mounts the mounting member to any desired surface, such as a wall, ceiling, pole or other building structure. Next, the installer connects an external power source to a power supply line connector associated with the mounting member. As discussed above, the mounting member may include a jumper adapted to complete and close the electrical circuit and electrically connect the battery in the emergency lighting assembly when it is secured to the mounting member. After the mounting member is mounted and the external power source is connected, the installer may complete assembly by mechanically securing the emergency lighting assembly to the mounting member. In some embodiments, a plurality of resilient arms secure the emergency lighting assembly to the mounting member. Securing the emergency lighting assembly to the mounting member also electrically connects the external power source to the unit to monitor that power source and recharge the battery.

DETAILED DESCRIPTION

Figure 1:
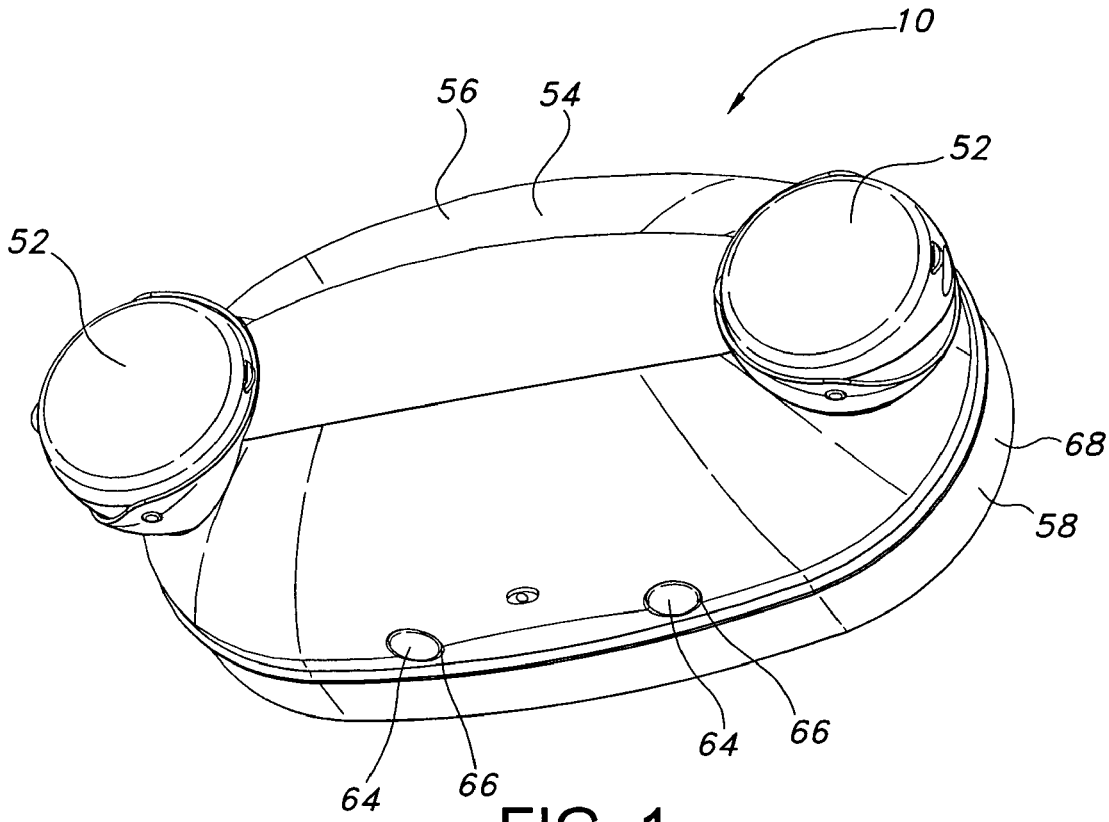
FIG. 1 shows a perspective view of an emergency lighting device according to a first embodiment of the present invention.

FIG. 1 shows an emergency lighting device 10 of the present invention. Emergency lighting device 10 includes a mounting member 12 and an emergency lighting assembly 14. Mounting member 12 is adapted to be mounted to any suitable or desirable structure, such as a wall, a ceiling, or a pole, typically by passing screws through any of numerous locations for such screws molded into mounting member 12 (e.g. 22 shown in FIG. 3). The emergency lighting assembly 14 is adapted to be mechanically secured to the mounting member 12.

With respect to electrically connecting mounting member 12 to emergency lighting assembly 14, the building's power cable is first routed through one of the openings 24 in mounting member 12 and attached to a terminal 28 on mounting member 12. Next, mechanically securing the emergency lighting assembly 14 to the mounting member 12, as discussed below, completes the electrical connections of the emergency lighting device 10 because edge finger contacts 34 and 46 of terminals 28 and 40 respectively receive contacts 36 and 48 on assembly 14, thereby connecting the external power source and completing assembly of the device's circuitry with an electrical jumper 38.

To mechanically secure the emergency lighting assembly 14 to the mounting member 12, the assembly 14 may be placed over the mounting member 12 such that a plurality of protrusions 16 engage a plurality of corresponding receivers 18. In the embodiment shown in FIG. 3, the plurality of protrusions 16 extend from the mounting member 12 and the receivers 18 are associated with the emergency lighting assembly 14.

Figure 4:
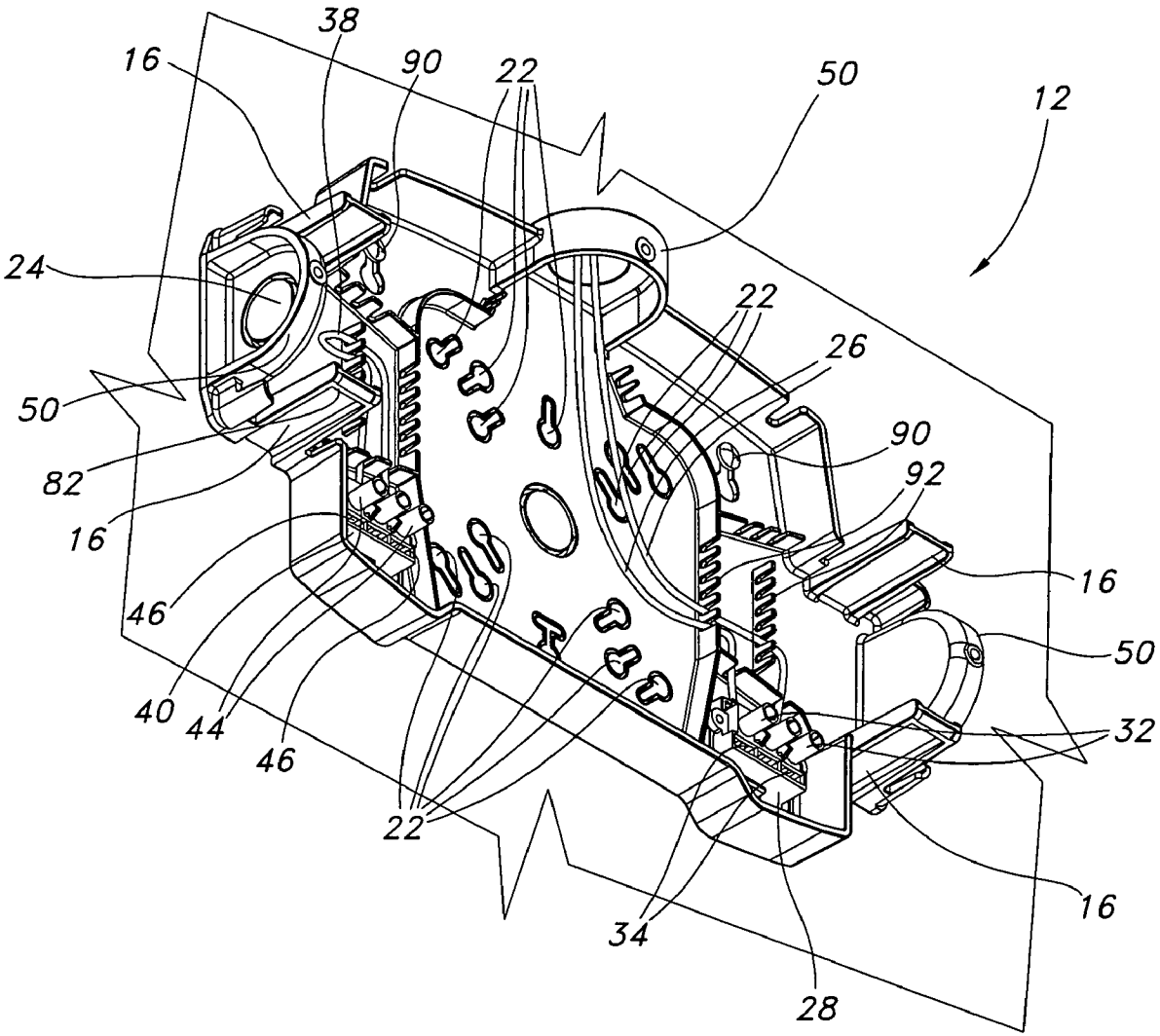
FIG. 4 shows a perspective view of a portion of the emergency lighting device shown in FIG. 3.
Figure 5:
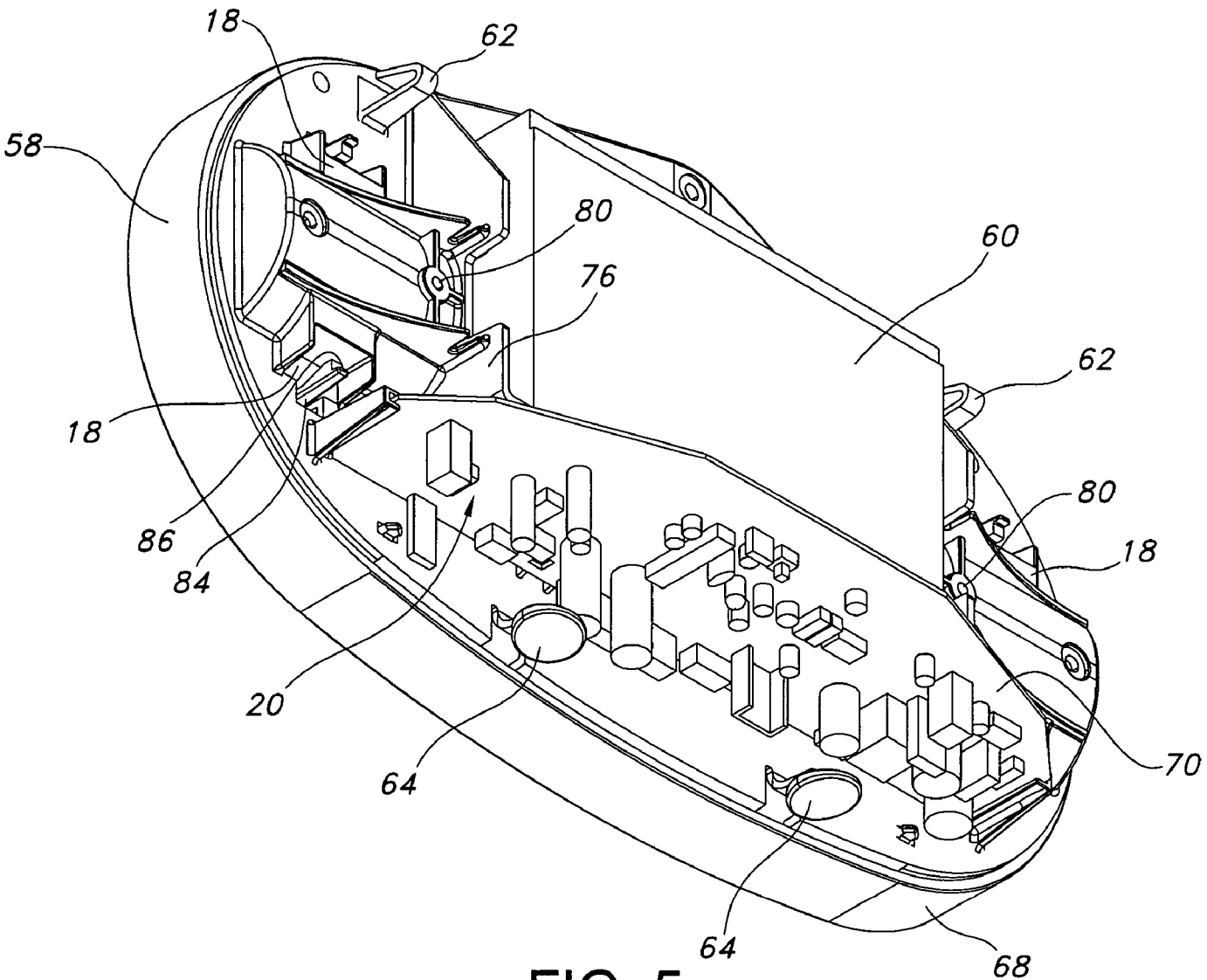
FIG. 5 shows a perspective view of another portion of the emergency lighting device shown in FIG. 3.

As shown in FIGS. 4 and 5, protrusions 16 includes a lip 82, and receiver 18 includes a resilient arm 84 such that inserting protrusions 16 into receivers 18 engage the resilient arms 84 with the lips 82 to secure the emergency lighting assembly 14 to the mounting member 12. Resilient arms 84 may include a tab 86, which facilitates using a fingernail, flathead screwdriver or other suitable device to disengage resilient arm 84 from lip 82, permitting the removal of the emergency lighting assembly 14 from the mounting member 12.

FIG. 4 shows in more detail the mounting member 12 of the emergency lighting device 10 shown in FIG. 1. Mounting member 12 may include frangible regions 22, which close the fastener openings so that passageways completely penetrating mounting member 12 are created only where the screws or fasteners are actually used.

Figure 2:
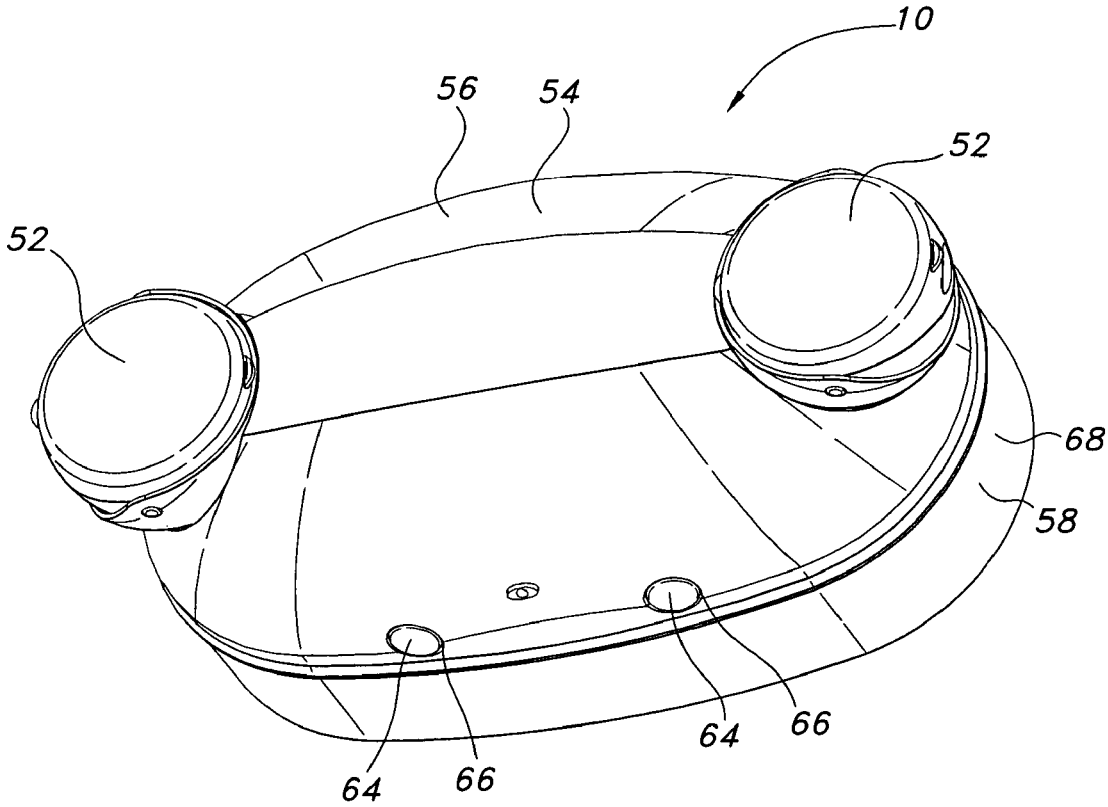
FIG. 2 shows a perspective view of an emergency lighting device according to a second embodiment of the present invention.

As shown in FIG. 2, removal of a frangible region 22 may form a keyhole slot in the mounting member 12. Fastener openings and frangible regions may be formed in any other suitable or desirable shape, the removal of which forms an aperture to receive a fastener 90 to secure mounting member 12 to the desired structure.

Figure 10:
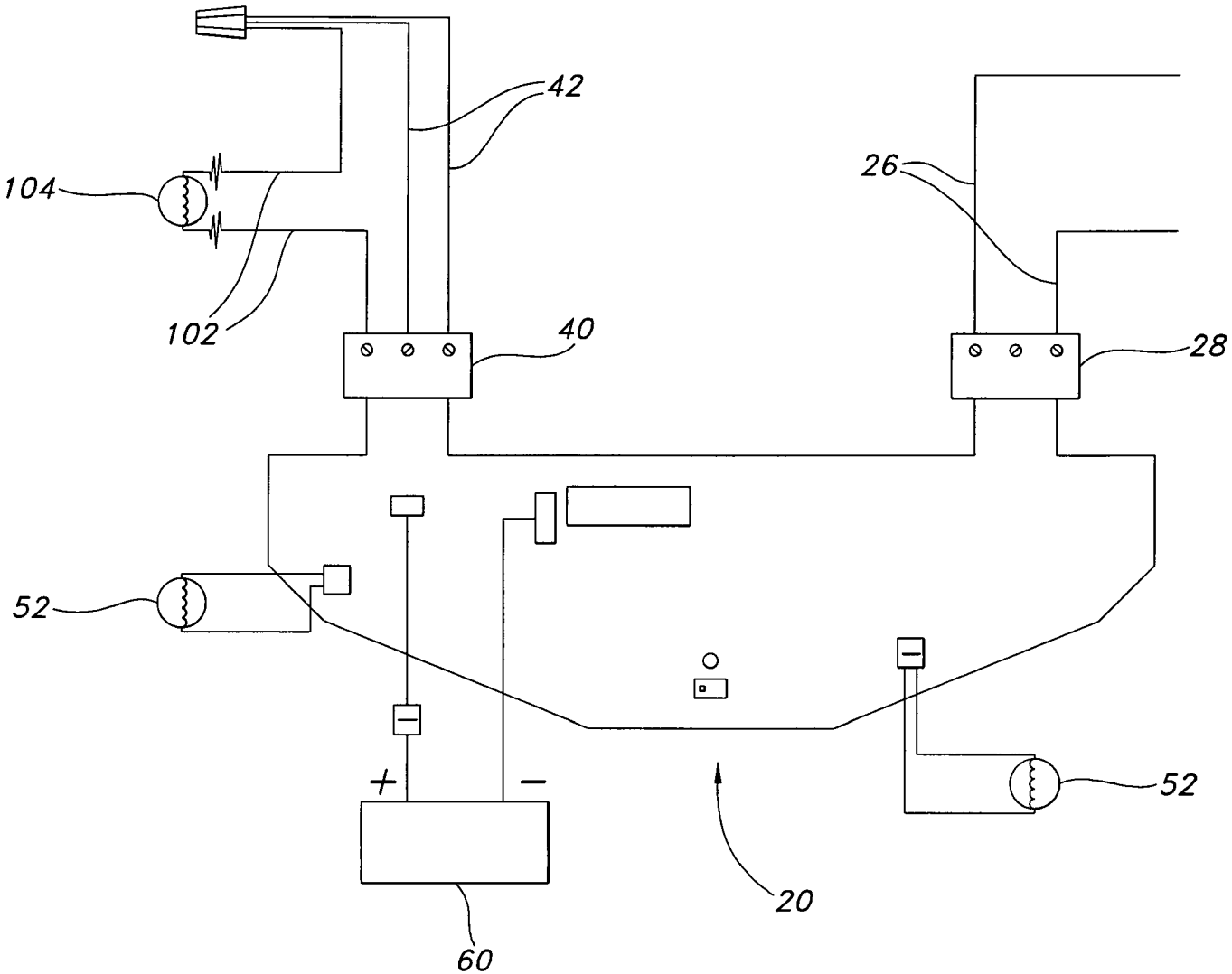
FIG. 10 shows a schematic wiring diagram of an emergency lighting device in accordance with alternate embodiments of the invention.

As shown in FIG. 4, mounting member 12 may also include a plurality of frangible portions 24 which, when removed, create entry portals: for a conduit containing power lines 26 from an external power source; for pendant mounting of the mounting member 12; or for entry points for wires to connect emergency lighting device 10 to remote emergency lights. In embodiments where remote emergency lights are desired, these lights may be electrically connected through the portals to the circuitry 20 of the emergency lighting device 10 such that the circuitry 20 can control the remote lights. FIG. 10 shows a schematic wiring diagram including wiring 102 for an remote light 104. In the embodiment shown in FIG. 10, the remote light 104 is wired to the same terminal block 40 as loop of wire 42. However, in other embodiments, remote light 104 may be connected to the device's circuitry 20 in any suitable manner.

The external power source 26 may be connected to a connector 28 associated with the mounting member 12. In the embodiment shown in FIG. 4, the connector is a terminal block 28, however, any desired or suitable connector may be used. As shown in FIG. 4, terminal block 28 is secured to the mounting member 12 by a number of resilient clips 30 extending from the mounting member 12 which engage terminal block 28 when it is inserted into the resilient clips 30. However, terminal block 28 may be secured to mounting member 12 in any suitable or desirable fashion, including brackets, screws, nuts and bolts, adhesives, or any other desired device or material.

Figure 6:
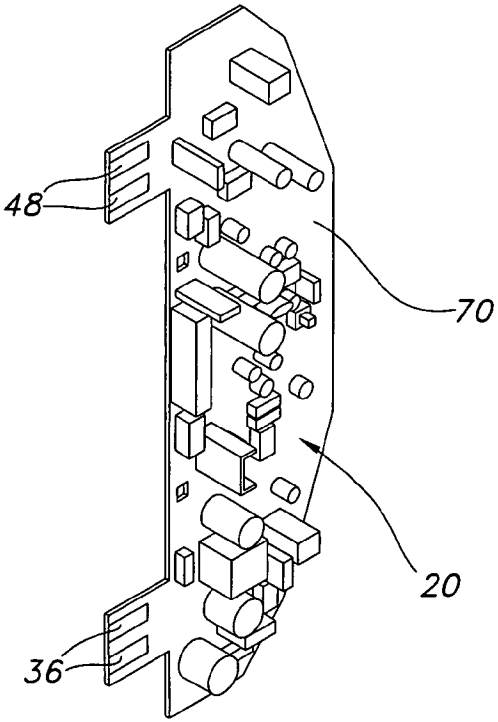
FIG. 6 shows a perspective view of the circuit board shown in FIG. 5.

As shown in FIG. 4, terminal block 28 includes two screw contacts 32 and two edge finger contacts 34 for receiving and connecting power line 26. Edge finger contacts 34 are adapted to electrically connect power lines 26 with the circuitry 20 of the emergency lighting assembly 14 shown in FIG. 3. When emergency lighting assembly 14 is secured to mounting member 12, the edge finger contacts 34 engage contacts 36. Contacts 36 (shown in FIG. 6) extend from circuit board 70, such that when edge finger contacts 34 engage contacts 36, electrical circuit 20 is coupled to the external power source 26.

In the embodiment shown in FIG. 4, mounting member 12 also includes an electrical jumper 38. Jumper 38 includes a terminal block 40 and a loop of wire 42. Loop of wire 42 is secured to terminal block 40 by screw contacts 44 in a similar manner as power lines 26 are secured to terminal block 28. Also in a similar manner to terminal block 28, securing emergency lighting assembly 14 to mounting member 12 engages edge finger contacts 46 on terminal block 40 with contacts 48 extending from circuit board 70 (shown in FIG. 6) and associated with electrical circuit 20. Electrically connecting jumper 38 to electrical circuit 20 in this manner completes assembly of electrical circuit 20, which is discussed in further detail below.

Figure 3:
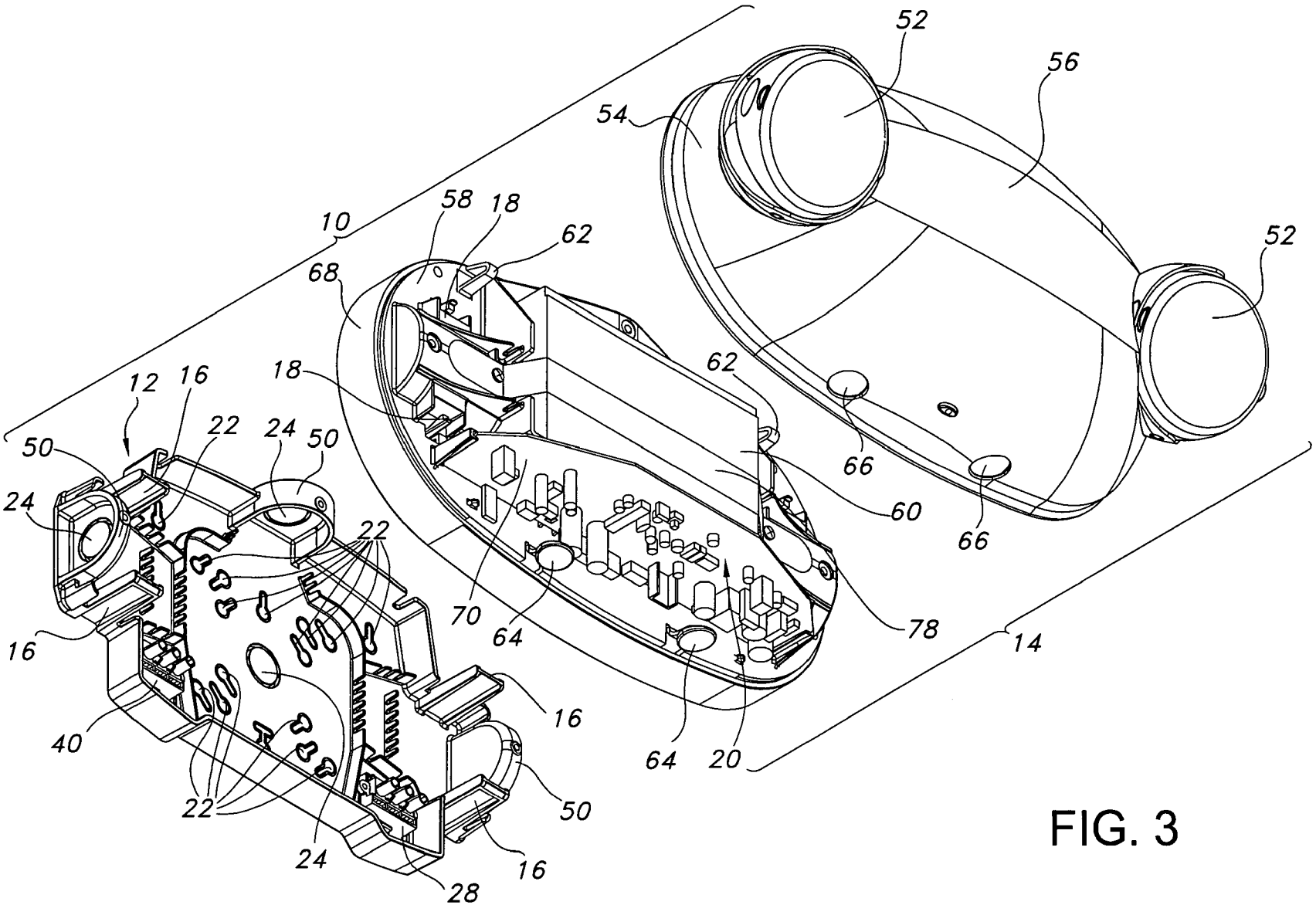
FIG. 3 shows an exploded view of the emergency lighting device shown in FIG. 1.

In the embodiment shown in FIG. 4, mounting member 12 is substantially planar, however, it may be formed in any suitable shape as desired. A number of slotted ridges 92 allow the various wires associated with mounting member 12 to be secured to retain the wires in unobtrusive locations and orientations. As shown in FIG. 3, mounting member 12 may also have surface features 50 which correspond with portions of emergency lighting assembly 14 to facilitate aligning emergency lighting assembly 14 with mounting member 12 to secure one to another.

In the embodiment shown in FIG. 3, the emergency lighting assembly 14 includes lights 52, housing 54 (which includes cover member 56 and back member 58), a battery 60, and unassembled electrical circuit 20.

Lights 52 are mounted on cover member 56. In the embodiment shown in FIG. 3, lights may be rotated or positioned in multiple orientations.

When housing 54 is assembled, which includes cover member 56 and back member 58, the housing 54 substantially encloses battery 60 and circuitry 20. Cover member 56 may be removably secured to back member 58. As shown in FIGS. 3 and 5, a pair of hooks 62 engage a pair of protrusions (not shown) on an inner surface of the cover member 56, and a pair of paddle shaped resilient arms 64 extending from the back member 58 engage a pair of apertures 66 formed in the cover member 56. The cover member 56 may be removed from the back member 58 by pressing in the paddle shaped resilient arms 64 and pivoting the cover member 56 off of the back member 58. In other embodiments, cover member 56 may be secured to back member 58 in any other suitable manner, such as by tabs, snap locks, press fit structures or any other suitable mechanism.

In still other embodiments that do not require the housing 54 to be opened to mount and install emergency lighting device 10, cover member 56 may be non-removable from the back member 58.

Housing 54, which includes cover member 56 and back member 58, may be formed in a variety of different sizes, shapes and configurations to accommodate any necessary or desired components. For example, for embodiments using multiple batteries, back member 58 may be formed with an increased depth to accommodate the batteries 60. FIG. 2 shows a housing 54 with increased depth.

In the embodiment shown in FIG. 3, an outer edge 68 of back member 58 substantially defines an oval shape and cover member 56 substantially defines at least a partial egg shape. When assembled, housing 54 fits over mounting member 12 to conceal most of member 12.

Figure 7:
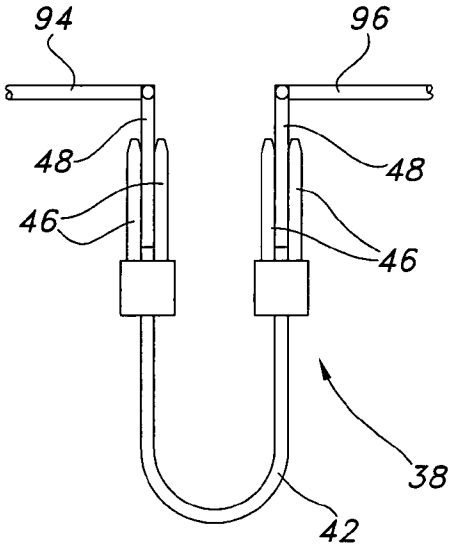
FIG. 7 shows schematically a portion of the circuitry of the emergency lighting device shown in FIG. 3.

FIG. 5 shows in more detail a portion of the emergency lighting assembly 14 of the emergency lighting device 10 shown in FIG. 3. In FIG. 5, the unassembled electrical circuit 20 is associated with a circuit board 70, which is mounted on back member 58. Because the unassembled electrical circuit 20 has not been completed, battery 60 may be connected to the circuitry 20 without losing its charge. Securing the emergency lighting assembly 14 to mounting member 12 completes the assembly of electrical circuit 20. When emergency lighting assembly 14 is secured to mounting member 12, edge finger contacts 46 of jumper 38 engage contacts 48 extending from circuit board 70 to electrically connect and engage a connector 48 in a sliding manner. As shown schematically in FIG. 7, contacts 48 are electrically connected to a first portion 94 and a second portion 96 of the electrical circuit 20 such that when jumper 38 is connected to contacts 48 the first portion 94 is electrically connected to the second portion 96 by jumper 38.

In the embodiment shown in FIG. 5, battery 60 is a rechargeable battery electrically connected to electrical circuit 20. However, battery 60 may be any suitable device capable of storing power to provide to lights 52 during power outages. Suitable batteries 60 may include rechargeable batteries, dry cell batteries, lead acid batteries, other types of batteries, or any other suitable storage device presently existing or made available in the future.

Battery 60 is supported by shelf member 76. Shelf member may be formed in any suitable shape and dimension to accommodate whatever number and size of batteries 60 desired. Shelf member 76 extends from back member 58. To further secure battery 60 to back member 58 a strap 78 may be installed over battery 60. The strap may be formed from any suitable material. In some embodiments hook and loop fasteners may be used as straps 78. In other embodiments, where a stronger hold is desired between battery 60 and back member 58, such as when emergency lighting device 10 is intended for ceiling mounting, a metal strap may be used. The strap 78 may be secured to back member 58 by a pair of fasteners engaged in holes 80.

The above description of the drawings is intended to describe the embodiments shown in the drawings. As will be appreciated by those skilled in the art, this invention can be practiced in numerous alternative embodiments in addition to those shown in the drawings and described above without departing from the spirit of this invention or the scope of the following claims.

For example, in various embodiments of this invention, the emergency lighting device 10 may be formed from any suitable material, including light weight materials such as polycarbonate plastic, ABS plastic, sheet metal, or any other suitable material.

In some embodiments, the emergency lighting device 10 may also include an illuminated or non-illuminated EXIT sign for indicating emergency exits in buildings.

In alternative embodiments of this invention, connectors 28 and 36 are not terminal blocks. Rather, connectors 28 and 36 may be any suitable alternative structure for coupling the external power source 26 to the circuitry 20 of the emergency lighting assembly 14.

Figure 9:
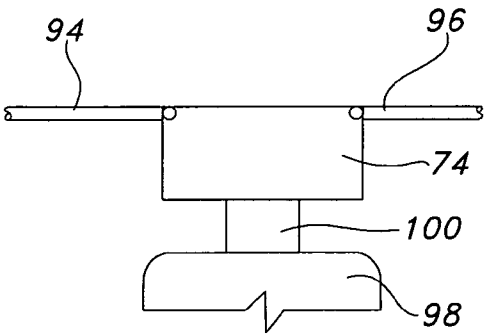
FIG. 9 shows schematically the portion of the circuitry shown in FIG. 8, shown in a closed configuration.
Figure 8:
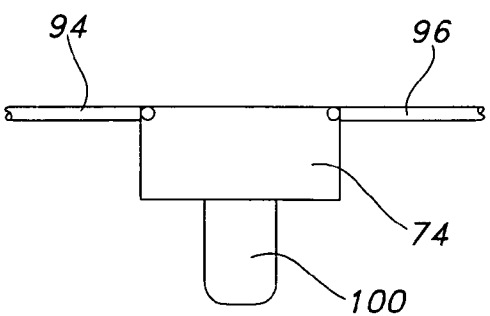
FIG. 8 shows schematically a portion of the circuitry of an emergency lighting device in accordance with alternate embodiments of the invention, shown in an open configuration.

Also in alternative embodiments, jumper 38 may be replaced with any suitable alternative devices. For instance, a single pole, single throw switch connected to the circuit 20 and mounted on the emergency lighting assembly 14 could be actuated by structure on member 12 when assembly 14 is mounted on member 12. Alternatively, a double pole, single throw switch could be used to simultaneously connect the batter 20 to the circuit and close the portion of the circuit closed as described above by jumper 38. FIGS. 8 and 9 show a switch 74 associated with first and second portions of the electrical circuit 94 and 96 respectively. In the embodiment shown schematically in FIGS. 8 and 9, securing the lighting assembly to the mounting member causes a portion of the mounting member 98 to depress a plunger 100 on switch 74 to electrically connect first and second portions of the electrical circuit 94 and 96.

The invention claimed is:

1. An emergency lighting device, comprising:

(a) a mounting member adapted for being mounted to a structure;

(b) an emergency lighting assembly comprising at least one light, at least one battery, a first portion of an electrical circuit and a second portion of the electrical circuit, the emergency lighting assembly adapted for being secured to the mounting member;

(c) one of the mounting member or the emergency lighting assembly comprising one or more protrusions with a lip;

(d) the other of the mounting member or the emergency lighting assembly comprising one or more receivers with a resilient arm;

(e) wherein securing the emergency lighting assembly to the mounting member electrically connects the first portion of the electrical circuit to the second portion of the electrical circuit, and allows the protrusion to be received by receiver such that the resilient arm is engaged by the lip.

2. The emergency lighting device of claim 1, wherein the mounting member further comprises a jumper; and wherein the jumper electrically connects the first portion of the electrical circuit to the second portion of the electrical circuit when the emergency lighting assembly is secured to the mounting member.

3. The emergency lighting device of claim 2, wherein the jumper comprises at least two edge finger contacts; wherein the first portion of the electrical circuit comprises a first circuit contact; wherein the second portion of the electrical circuit comprises a second circuit contact; and wherein securing the emergency lighting assembly to the mounting member engages the at least two edge finger contacts with the first and second circuit contacts in a sliding manner.

4. The emergency lighting device of claim 3, wherein securing the emergency lighting assembly to the mounting member energizes the electrical circuit.

5. The emergency lighting device of claim 1, wherein securing the emergency lighting assembly to the mounting member closes a switch to electrically connect the first portion of the electrical circuit to the second portion of the electrical circuit.

6. The emergency lighting device of claim 1, wherein the resilient arm of the one or more receivers guides the emergency lighting assembly into secure engagement with the mounting member.

7. The emergency lighting device of claim 1, wherein the emergency lighting assembly further comprises a housing, the housing at least substantially enclosing the at least one battery, the first portion of the electrical circuit and the second portion of the electrical circuit; wherein the emergency lighting assembly is adapted to be secured to the mounting member without opening the housing; and wherein the first portion of the electrical circuit and the second portion of the electrical circuit are adapted for being electrically connected without opening the housing.

8. An emergency lighting device, comprising:

(a) a mounting member:

(i) adapted for being mounted to a structure; and (ii) comprising a first power line connector adapted for being electrically connected to an external power source and at least one protrusion with a lip; and (b) an emergency lighting assembly comprising at least one light, at least one battery, at least a portion of an electrical circuit, a second power line connector, and at least one receiver with a resilient arm; wherein the emergency lighting assembly is secured to the mounting member by mating the at least one protrusion and the at least one receiver such that the resilient arm engages the lip; and wherein securing the emergency lighting assembly to the mounting member connects the first and second power line connectors.

9. The emergency lighting device of claim 8, wherein the first power line connector comprises a terminal block comprising at least two screw contacts and at least two edge finger contacts; wherein the at least two screw contacts are adapted for being electrically connected to the external power source; and wherein the at least two edge finger contacts are adapted for being electrically connect to the second power line connector in a sliding manner.

10. The emergency lighting device of claim 8, wherein the resilient arm of the one or more receivers guides the emergency lighting assembly into secure engagement with the mounting member.

11. The emergency lighting device of claim 10, wherein the at least one protrusions extends from the mounting member and wherein the at least one receivers is associated with the emergency lighting assembly.

12. The emergency lighting device of claim 8, wherein the emergency lighting assembly further comprises a housing substantially enclosing the at least one battery, the portion of the electrical circuit, and the second power line connector; wherein the emergency lighting assembly is adapted for being secured to the mounting member without opening the housing; and wherein the first power line connector is adapted for being engaged with the second power line connector without opening the housing.

13. An emergency lighting device, comprising:

(a) a mounting member adapted for being secured to a structure;

(b) an emergency lighting assembly comprising at least one light and at least one battery; wherein the at least one light and at least one battery are associated with an uncompleted electrical circuit; wherein the emergency lighting assembly is adapted for being secured to the mounting member; and wherein securing the emergency lighting assembly to the mounting member couples the uncompleted electrical circuit to a power source and completes assembly of the uncompleted electrical circuit, and (c) a plurality of protrusions and a plurality of receivers; wherein the plurality of receivers comprise one or more resilient arms; wherein the plurality of protrusions are adapted to be engaged with the plurality of receivers, wherein engaging the plurality of protrusions with the plurality of receivers secures the emergency lighting assembly to the mounting member.

14. The emergency lighting device of claim 13, wherein the emergency lighting assembly further comprises a housing, the housing substantially enclosing the at least one battery and the at least one uncompleted electrical circuit; and wherein the uncompleted electrical circuit is adapted for being completed without opening the housing.

15. The emergency lighting device of claim 14, further comprising a jumper associated with the mounting member; wherein the uncompleted electrical circuit comprises a first portion and a second portion; and wherein securing the emergency lighting assembly to the mounting member electrically connects the first portion of the uncompleted electrical circuit to the second portion of the uncompleted electrical circuit through the jumper to complete assembly of the uncompleted electrical circuit.

16. The emergency lighting device of claim 15, wherein securing the emergency lighting assembly to the mounting member energizes the electrical circuit.

17. The emergency lighting device of claim 13, wherein the emergency lighting assembly further comprises a housing substantially enclosing the at least one battery and the uncompleted electrical circuit; and wherein the uncompleted electrical circuit is adapted for being coupled to the power source line without opening the housing.

18. The emergency lighting device of claim 17, wherein the housing comprises a back member and a cover member; and wherein an outer edge of the back member defines a substantially oval shape.

19. The emergency lighting device of claim 18, wherein at least a portion of the cover member substantially defines an at least partial egg shape.

20. The emergency lighting device of claim 19, wherein the cover member is adapted for being secured to the back member such that a portion of the cover member contacts a portion of the back member along an oval contact region.

21. The emergency lighting device of claim 17, wherein the mounting member further comprises at least one frangible portion; and wherein removal of the frangible portion facilitates connecting a remote emergency light to the emergency lighting device.

22. An emergency lighting device, comprising:

(a) a mounting member adapted for being mounted to a structure and comprising a remote lamp connector for electrically connecting the emergency lighting device to a remote lamp; and (b) an emergency lighting assembly comprising at least one light, at least one battery, at least a portion of an electrical circuit, and at least a second remote lamp connector; and wherein securing the emergency lighting assembly to the mounting member electrically connects the remote lamp connector to the portion of the electrical circuit, and wherein one of the mounting member or the emergency lighting assembly comprises one or more protrusions with a lip, and the other of the mounting member or the emergency lighting assembly comprises one or more receivers with a resilient arm, wherein in use, the one or more protrusions are received by the one or more receivers such that the resilient arm is engaged by the lip.

23. The emergency lighting device of claim 22, wherein the emergency lighting assembly further comprises a housing substantially enclosing the at least one battery and the portion of the electrical circuit; and wherein the portion of the electrical circuit is adapted for being electrically connected to the remote lamp without opening the housing.

24. The emergency lighting device of claim 23, wherein securing the emergency lighting assembly to the mounting member completes the portion of the electrical circuit.

25. The emergency lighting device of claim 23, wherein securing the emergency lighting assembly to the mounting member couples the portion of the electrical circuit to an external power supply.

* * * * *